US009068385B2

(12) United States Patent
Proctor et al.

(10) Patent No.: US 9,068,385 B2
(45) Date of Patent: Jun. 30, 2015

(54) CAVITY DOOR ROLLERS

(71) Applicant: Anthony Innovations Pty Ltd, Thomastown (AU)

(72) Inventors: Nigel Proctor, Thomastown (AU); Derek Jefferson, Thomastown (AU)

(73) Assignee: Anthony Innovations Pty Ltd., Thomastown, Victoria (AU)

( * ) Notice: Subject to any disclaimer, the term of this patent is extended or adjusted under 35 U.S.C. 154(b) by 0 days.

(21) Appl. No.: 14/107,452

(22) Filed: Dec. 16, 2013

(65) Prior Publication Data

US 2014/0165330 A1 Jun. 19, 2014

(30) Foreign Application Priority Data

Dec. 19, 2012 (AU) ..... 2012905556

(51) Int. Cl.
*E05D 15/06* (2006.01)
*E05D 15/00* (2006.01)

(52) U.S. Cl.
CPC ..... *E05D 15/063* (2013.01); *Y10T 16/381* (2015.01); *E05Y 2600/312* (2013.01)

(58) Field of Classification Search
CPC ... E05D 15/0626; E05D 15/264; E05D 15/06; E05D 15/063; E05D 15/0643; E05D 15/0647; E05D 15/165; E05Y 2201/64; E05Y 2201/688; E05Y 2201/708; E05Y 2201/612; E05Y 2201/614; A47H 15/00; A47H 15/02; A47H 15/04; A47H 2001/00; A47H 2015/00
USPC ..... 16/90, 91, 94 R, 96 R, 95 R, 97, 16/101–107, 87 R, 84 R, 87.6 R, 87.8, 273; 160/185, 199; 49/404, 409, 410, 411, 49/412, 420, 421–425, 453, 455
See application file for complete search history.

(56) References Cited

U.S. PATENT DOCUMENTS

| | | | | | |
|---|---|---|---|---|---|
| 3,155,051 | A * | 11/1964 | Sherburne | 105/155 |
| 3,361,489 | A * | 1/1968 | Gionet | 384/19 |
| 3,479,682 | A * | 11/1969 | McNinch | 16/97 |
| 3,708,827 | A * | 1/1973 | Foltz | 16/98 |
| 3,874,748 | A * | 4/1975 | Figueroa | 384/19 |
| 4,589,702 | A * | 5/1986 | Bach et al. | 301/64.704 |
| 4,642,844 | A * | 2/1987 | Johnston | 16/98 |
| 4,863,288 | A * | 9/1989 | Houck | 384/19 |
| 4,979,262 | A * | 12/1990 | Lautenschlager | 16/97 |
| 5,580,174 | A * | 12/1996 | Houck | 384/19 |
| 6,200,032 | B1 * | 3/2001 | Ropp | 384/58 |
| 7,962,999 | B2 * | 6/2011 | Yeh | 16/97 |

* cited by examiner

*Primary Examiner* — Chuck Mah
(74) *Attorney, Agent, or Firm* — Miller Law Group, PLLC

(57) ABSTRACT

The specification discloses a wheel carriage assembly (10) for supporting sliding doors or other similar panels with the wheel carriage assembly (10) rolling along a fixed guide track (11), the wheel carriage assembly (10) having at least one and often multiple pairs (17, 18) of laterally spaced wheels (19, 20) adapted to roll along the fixed guide track (11), the wheels (19, 20) of the or each said pair of wheels (17, 18) being mounted to a shaft (21) and at least one of the wheels (19, 20) being capable of limited axial movement relative to the shaft (21).

14 Claims, 1 Drawing Sheet

CAVITY DOOR ROLLERS

FIELD OF THE INVENTION

The invention relates to improvements in wheel carriage assemblies for supporting sliding doors and other similar panels including windows and concertina door panels. The invention will be described hereafter with reference to cavity sliding doors but can be used in other applications.

BACKGROUND TO THE INVENTION

Wheel carriage assemblies for supporting cavity sliding doors typically comprise spaced pairs of wheels, each pair being supported by a shaft with the shafts being carried by a support housing. The support housing typically has a connection means enabling the support housing to be connected to a top edge of the door. In use a downwardly open channel is installed along an upper edge zone of the cavity in which the door is intended to slide. Conveniently, lower edge zones of side walls of the channel are turned inwardly at an obtuse angle to the respective side walls. The inturned and inclined portions are often also turned upwardly to form a 'V' groove on each side of the channel. In use the wheels of the wheel carriage assemblies roll in the laterally spaced 'V' shaped groove portion as the door moves slidingly along the channel. Other track configurations are possible particularly for different panel support arrangements. It is, however, common for the guide track structure to be formed as a rolled metal product with the result that its dimensions along its length will often vary considerably. The rolled forming technique provides a relatively inexpensive part but its lack of accurate dimensional form can interfere with conventional wheel carriage assemblies, particularly when the wheels are rolling in the 'V' shaped groove portions.

The objective of the present invention is to provide an improved wheel carriage assembly of the aforementioned kind that will minimize difficulties with dimensional variability of roll formed supporting channels for the wheel carriage assembly.

SUMMARY OF THE INVENTION

Accordingly, the present invention provides a wheel carriage assembly including at least a pair of laterally spaced rotatable wheels supported by a support structure and, in use, adapted to roll along a defined guide track, at least one of said pair of laterally spaced wheels being mounted for limited axial movement whereby the distance between rolling planes of said pair of laterally spaced wheels is variable. Conveniently, the relative axial movement of at least one of said pair of laterally spaced wheels occurring by application of external forces, for example by variations in said defined guide track. The variable pitch or spacing between the at least one pair of wheels of the wheel assembly enables automatic adjustment for variable spacings of the rolling track for each wheel as the wheel carriage assembly moves along the guide track.

Preferably the support structure is adapted to mount connector means, said connector means enabling the support structure to be connected, in use, to a sliding door or other sliding panel. Conveniently the support structure includes releasable mounting means to enable said connector means to be mounted therefrom.

In a preferred embodiment said pair of laterally spaced wheels are mounted to opposed ends of a common shaft, said common shaft being supported centrally between said pair of laterally spaced wheels by a bearing whereby said common shaft is rotatable relative to said bearing, said at least one of the pair of laterally spaced wheels being mounted for limited axial movement relative to said common shaft, said support structure mounting and holding said bearing. Conveniently, both said wheels of said pair of laterally spaced wheels are capable of limited axial movement relative to said common shaft.

In another preferred embodiment, the wheel carriage assembly may further include at least one further pair of laterally spaced wheels supported by said support structure whereby, in use each of the wheels of said further pair of laterally spaced wheels are rotatable relative to said support structure. Conveniently, all said wheels are arranged in laterally spaced pairs with each said pair being supported by a common shaft. Preferably, one only said wheel of one of said pairs of separate wheels are capable of limited axial movement relative to said common shafts. In an alternative arrangement, at least one said wheel of each of said pairs of separate wheels are capable of limited axial movement.

Conveniently, each said opposed end of the common shaft carrying said wheels capable of limited axial movement has a recessed zone with a first axial length, a said wheel mounted to the common shaft having an inward directed formation received in said recessed zone, said formation having a second axial length less than said first axial length permitting said limited axial movement between said wheel and said common shaft. Preferably each said recessed zone is a circumferential groove.

In yet another preferred embodiment, each said opposed end of the common shaft has an outward directed formation with a first axial length, the wheel mounted to said opposed end of said common shaft having a recessed zone formed in a bore accommodating said common shaft, said recessed zone having a second axial length greater than said first axial length, said outward directed formation being received in said recessed zone permitting said limited axial movement between said wheel and said common shaft. Conveniently each said recessed zone is a circumferential groove.

Preferably, each said wheel includes a first axially outer section of relatively greater diameter having a perimeter surface on which the wheel is adapted to roll, said wheel further having a second axially inner section of relatively smaller diameter with an inner axial facing end surface directed towards said bearing, said end surface being separate from or providing a slidable engagement on said bearing regardless of the location of said wheel on said common shaft.

In accordance with a second aspect, there is provided a wheel assembly including a shaft and a separate wheel carried on each end of said shaft, at least one said wheel being retained on said shaft and capable of limited sliding movement relative to said shaft independent of the other said wheel.

In accordance with the aforesaid second aspect, the shaft may have a recessed zone with a first axial length formed in its outer peripheral surface spaced inwardly from each end of the shaft, each said wheel having an inwardly directed formation received in a said recessed zone, said formation having a second axial length less than said first axial length permitting said limited axial movement between said wheel and said shaft. Each said recessed zone may be a circumferential groove. Alternatively, the recessed zone may have a limited circumferential dimension. In another arrangement, the shaft may have an outwardly directed formation adjacent each axial end, each said formation being adapted to engage in and be retained by a recessed zone in an axial bore of a said wheel.

One possible preferred embodiment will hereinafter be described with reference to the accompanying drawings.

DETAILED DESCRIPTION OF PREFERRED EMBODIMENT

Figure 2:
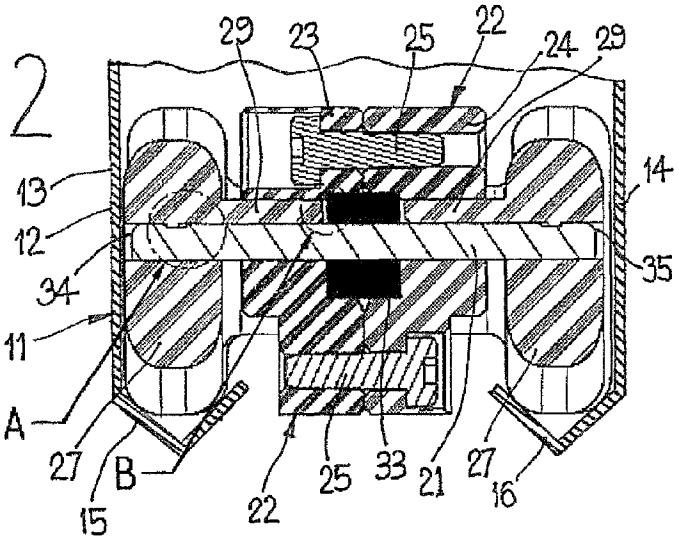
FIG. 2 is a front section view of the embodiment shown in FIG. 1, also showing the channel guide track in which the assembly might roll.
Figure 1:
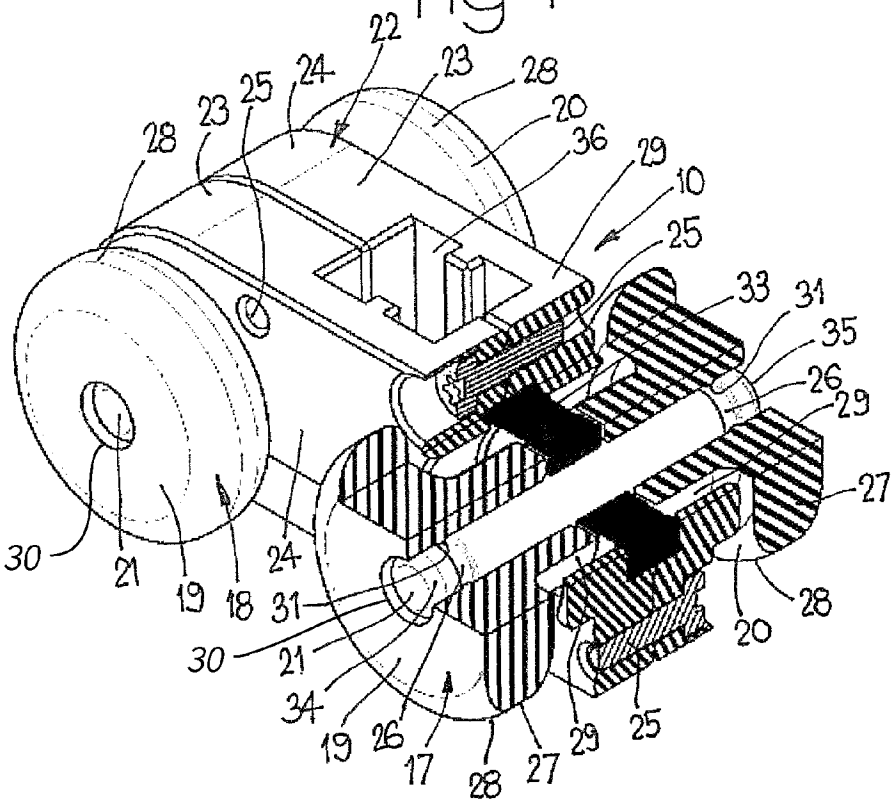
FIG. 1 is a perspective view, partially in section and partly broken away, of a wheel carriage assembly according to the present invention.

Referring to the drawings, FIGS. 1 and 2 shows a wheel carriage assembly 10 for supporting a sliding door (not shown) in a cavity sliding door application, or in any equivalent application. Such sliding doors are supported from a guide track 11 in the form of an inverted channel 12 having side walls 13, 14 and inturned lower flanges 15, 16 formed into 'V' grooves, that are located inwardly from the planes of the side walls 13, 14 (FIG. 2). The wheel carriage assembly 10 has two pairs of rolling wheels 17, 18, each having wheel members 19, 20 carried on opposed ends of a common shaft 21. The common shafts 21 are each cradled in a bearing 33 whereby the shaft 21 and the wheel members 19, 20 carried thereon rotate when the wheel pair 17 or 18 roll along the guide track 11. In doing so the wheel members 19, 20 roll on the inturned flanges 15, 16 (FIG. 2) formed into a 'V' groove in the embodiment illustrated. It will of course be appreciated that other configurations of the guide track 11 could equally be employed.

Figure 4:
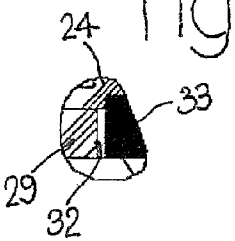
FIG. 4 is a detailed section view of the area marked B in FIG. 2.
Figure 3:
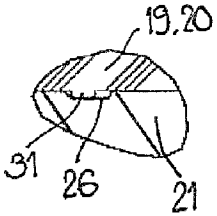
FIG. 3 is a detail section view of the area marked A in FIG. 2.

The wheel pairs 17, 18 are supported by a support housing 22 comprised of two housing parts 23, 24 secured together, when assembled, by fasteners 25. In the illustrated embodiment the fasteners 25 are screw threaded fasteners but could be bolts or snap together elements. In the assembled condition, the housing parts 23, 24 firmly locate and hold the bearing 33 in position. The number of housing parts should be seen as non-limiting as other forms of the housing 22 are possible. Any number of housing parts could be used or the support structure could be made up of a single housing part. The shaft 21 has a pair of circumferential grooves 26 formed in its surface, each with a defined width. The grooves 26 are positioned such that each will be overlaid by one of the wheel members 19 or 20. Each wheel member 19 or 20 has a first part 27 forming a peripheral rolling surface 28, and a second part 29 extending inwardly from the first part 27. The wheel members 19, 20 both have a bore 30 extending through both parts 27, 29. The bore 30 fits over a respective end of the common shaft 21 and has an inwardly directed circumferentially extending rib 31 of a second defined width that is substantially less than the width (axial length) of the groove 26 (FIG. 3). Furthermore, when the wheel carriage assembly 10 is assembled, the rib 31 of each wheel member 19, 20 is engaged in a respective groove 26. This retains the wheel member 19, 20 on the shaft 21 but also permits a limited relative axial movement between the wheel member 19 or 20 and the shaft 21 because of the difference in widths of the rib 31 and the groove 26. As shown in FIG. 4, the length of the second part 29 of the wheel members 19, 20 is such that a gap exists between its end face 32 and the bearing 33 sufficient to also permit the limited movement of the wheel members 19, 20 axially relative to the shaft 21. The shaft 21 has chamfered surfaces 34, 35 at each end to assist with pressing the bores 30 of the wheel members 19, 20 thereover when assembling same. While the preferred embodiment illustrated in the drawing shows each of the wheel members 19, 20 being capable of limited axial movement relative to the shaft 21, an arrangement where only one of the wheel members 19 or 20 is axially movable will also work satisfactorily.

In use, a connector means is mounted from the support housing 22 intermediate the front and rear of the wheel carriage assembly 10 at 36 to enable a top edge of a door or other sliding panel to be connected thereto for movement with the carriage assembly 10 along the track 11. Alternatives to the above preferred embodiments are possible within the scope of the annexed patent claims. One possible alternative might be to provide the groove 26 on the inside of the bore 30 with the ribs 31 being formed on the common shaft 21. Other modifications and variations will be apparent to those skilled in the art. For example, it is recognized that the wheels do not need to rotate relative to the shaft carrying the wheels. Accordingly, the projecting formation described as a rib above may be formed as a discrete formation fitting within a discrete recessed zone such that the wheel is positively restrained from rotation relative to the shaft but with appropriate dimensioning is capable of limited axial movement. While the support housing is described above as a two part structure, multiple part arrangements or a single part structure might also be utilized. While the preferred embodiment shown in the drawings shows the shaft 21 rotatably mounted in a central bearing 33, it is possible for the wheel members to be mounted on stub shafts with individual bearings so long as at least one (or both) wheel members is/are capable of axial movement. The drawings also show two pairs of wheel members 19, 20 spaced from one another. Three or more pairs of wheel members 19, 20 can be utilized. Generally it is necessary for only one of the pairs of wheels to be constructed with at least one of the wheels being relatively movable axially.

The invention claimed is:

1. A wheel carriage assembly including at least a pair of laterally spaced wheels mounted to opposed ends of a first common shaft, said first common shaft being supported intermediate said opposed ends by a first bearing mounted in a support structure of said wheel carriage assembly whereby said laterally spaced wheels rotate with said first common shaft relative to said support structure, at least one of said pair of laterally spaced wheels having a bore through which said first common shaft passes, one of either said bore or said first common shaft having a first projecting formation received within a first recessed zone formed in the other of either said bore or said first common shaft, said first recessed zone having a first axial length, said first projecting formation having an axial length less than the first axial length of the first recessed zone whereby the at least one of said pair of laterally spaced wheels has limited axial movement relative to said first common shaft, said limited axial movement being restrained by said projecting formation engaging axial ends of said first recessed zone.

2. A wheel carriage assembly according to claim 1 further including connector means enabling the support structure to be connected, in use, to a sliding door or other sliding panel.

3. A wheel carriage assembly according to claim 1 wherein both said wheels of said pair of spaced wheels and said first common shaft include said first projecting formation and said first recessed zone so that both said wheels have limited axial movement relative to said first common shaft.

4. A wheel carriage assembly according to claim 1 further including a further pair of laterally spaced wheels mounted to opposed ends of a second common shaft spaced from said first common shaft, said second common shaft being supported at an intermediate location by a second bearing mounted in said support structure, said further pair of laterally spaced wheels being rotatable with said second common shaft relative to said support structure, each said wheel of said further pair of wheels is axially fixed relative to said second common shaft.

5. A wheel carriage assembly according to claim 1 further including a further pair of laterally spaced wheels mounted to opposed ends of a second common shaft spaced from said first common shaft, said second common shaft being supported at an intermediate location by a second bearing mounted in said support structure, said further pair of laterally spaced wheels being rotatable with said second common shaft relative to said support structure, one only of said further pair of wheels is mounted to said second common shaft whereby said one wheel has limited axial movement relative to said second common shaft.

6. A wheel carriage assembly according to claim 1 further including a further pair of laterally spaced wheels mounted to opposed ends of a second common shaft spaced from said first common shaft, said second common shaft being supported at an intermediate location by a second bearing mounted in said support structure, said further pair of laterally spaced wheels being rotatable with said second common shaft relative to said support structure, both said wheels of said further pair of wheels have limited axial movement relative to said second common shaft.

7. A wheel carriage assembly according to claim 1 wherein said first projecting formation extends inwardly from a surface of said bore and said first recessed zone is formed in said first common shaft.

8. A wheel carriage assembly according to claim 7 wherein said first recessed zone is a circumferential groove formed in said first common shaft.

9. A wheel carriage assembly according to claim 8 wherein a second one of said wheels mounted to opposed ends of said first common shaft has a bore through which said first common shaft passes, the bore of said second one of said wheels having an inwardly extending second projecting formation received within a second recessed zone formed in said first common shaft, said second recessed zone having a second axial length, said second projecting formation having an axial length less than said second axial length of said second recessed zone whereby said second one of said wheels has limited axial movement relative to said first common shaft.

10. A wheel carriage assembly according to claim 9 wherein said second recessed zone is formed as a circumferential groove in said first common shaft.

11. A wheel carriage assembly according to claim 1 wherein a first recessed zone is formed in a surface of said bore with said first projecting formation extending outwardly from said first common shaft, said first recessed zone having a first axial length, said first outwardly directed formation having an axial length less than the first axial length of the first recessed zone in said bore.

12. A wheel carriage assembly according to claim 11 wherein said first recessed zone in said bore is a circumferential groove in said bore.

13. A wheel carriage assembly according to claim 11 wherein a second one of said wheels mounted to opposed ends of said first common shaft has a bore within which said first common shaft is positioned, said bore having an axially extending second recessed zone having a second axial length, said first common shaft having a second projecting formation extending outwardly and received in said second recessed zone, said second projecting formation having an axial length less than the second axial length of the second recessed zone in said bore.

14. A wheel carriage assembly according to claim 13 wherein said second recessed zone in said bore is a circumferential groove.

* * * * *